US005356047A

United States Patent [19]

Rogers

[11] Patent Number: 5,356,047

[45] Date of Patent: Oct. 18, 1994

[54] CONSUMER GASOLINE TESTER

[76] Inventor: Ronald G. Rogers, 1226 Prestige La., St. Louis, Mo. 63137

[21] Appl. No.: 106,364

[22] Filed: Aug. 13, 1993

[51] Int. Cl.[5] ..... B67D 5/38

[52] U.S. Cl. ..... 222/158; 222/465.1; 141/331; 141/344

[58] Field of Search ..... 222/158, 460, 465.1, 222/563, 548; 141/331, 333, 344, 345

[56] References Cited

U.S. PATENT DOCUMENTS

| | | | |
|---|---|---|---|
| 216,530 | 6/1879 | Pfitzenmeier | 141/331 X |
| 1,020,602 | 3/1912 | Hamrick | 141/331 X |
| 2,024,168 | 12/1935 | Kneer | 141/344 |
| 2,636,208 | 4/1953 | Leeper | 141/331 X |
| 4,031,032 | 6/1977 | Jablecki | 141/344 X |
| 5,108,016 | 4/1992 | Waring | 222/158 X |
| 5,186,358 | 2/1993 | McVay | 141/344 X |
| 5,226,574 | 7/1993 | Durinzi, Jr. | 222/465.1 |
| 5,228,488 | 7/1993 | Fletcher | 141/344 X |

FOREIGN PATENT DOCUMENTS

| | | | |
|---|---|---|---|
| 0473841 | 3/1992 | European Pat. Off. | 141/344 |

*Primary Examiner*—Gregory L. Huson

[57] ABSTRACT

A consumer gasoline tester having a design type of easy handling and storage for convenience. The tester will have at the top a funnel spout apparatus (10) with a plastic nozzle stop (18) at the base. The nozzle connects to a clear plastic container (16) which has an easy-grip handle (12). The bottom of the container has a threaded hole for attaching the butterfly valve (20) and draining hose (22). The container is clearly marked for precise measurement with quantity indicators (14). There is an additional flaired-bottom container (28) with a circular handle (26) and screw-on cap (24) to be used to store suspect gasoline.

1 Claim, 4 Drawing Sheets

CONSUMER GASOLINE TESTER

BACKGROUND—FIELD OF THE INVENTION

This invention relates to consumer protection, specifically by enabling the consumer to inspect, at the pump, all gasoline before it enters the gas tank.

BACKGROUND—DESCRIPTION OF PRIOR ART

A search for previous relevant developments in the same technological area resulted in no known prior art. The novelty of this invention sets it apart from all that is currently publicly noticeable. Some of the disadvantages of such findings are these:

(a) Across the country, gasoline stations have perpetually participated in a scam in which the perpetrators intake enormous amounts of cash, at the consumer's expense. Some gas stations have systematic ways of defrauding the consumer at the gas pump every time gas is purchased.

(b) Some states with the most influential tourist attractions have gasoline stations that actively participate in the scam. One spends time having repairs done on his automobile while on vacation in these states.

(c) Bad gasoline causes clogged carburetors, ruined fuel injectors, knocking or destroyed engines.

(d) There are one hundred fifty million drivers in the United States of which one third are at risk of consumer fraud due to this scam.

(e) Twenty-two states across the United States have no laws on gasoline quality and a large number of states that do have laws, don't enforce them.

(f) It is a known fact that even in the states that are trying to check on gasoline quality, there are many problems; the majority of those problems begin at the gas pump.

(g) As much as thirty cents per gallon of gasoline is defrauded right at the pump. The perpetrators stand to gain as much as twenty thousand to thirty thousand dollars a month at the consumer's expense.

(h) In California alone, one out of six gasoline stations had problems with their gas (taken from a one year study).

(i) Something called "cocktailing" (big tanker trucks used to mix gasoline with cheap waste oil, known as transmix) has been going on for quite some time around the country.

(j) Some gasoline stations have extremely clever methods for cheating the consumer. One example is hidden switches to control cheating from inside the station(k)

(k) Adulterated and contaminated gasoline has been declared a widespread problem.

(l) New York has been found to have gasoline problems equivalent to those in California.

(m) Gasoline fraud has been declared one of the biggest forgeries, in terms of victims and dollars.

(n) Consumers are at the mercy of the perpetrators of this gasoline scam.

OBJECTS AND ADVANTAGES

Accordingly, besides the objects and disadvantages described in my above patent, several objects and advantages of this invention are:

(a) to provide the consumer with a means of defense against blatant gasoline fraud.

(b) to provide a sure way to prevent tainted gasoline from entering the consumer's gas tank.

(c) to provide the consumer with an instrument that allows for clear viewing and precise measurement while at the pump.

(d) to provide the consumer with the evidence needed to expose gasoline stations who willfully participate in gasoline fraud; tainted gasoline can be labeled and turned in to state authorities.

(e) to provide the consumer with an instrument that will make virtually every motorist a potential quality control inspector of gasoline.

(f) to provide help to undercover gasoline inspectors in locating the perpetrators of this multi-million dollar scam and simultaneously help states across the United States better enforce existing laws against such fraud.

(g) to stop consumers from being at the mercy of this fraud scam.

(h) to help the consumer protect the investment in the purchase of an automobile and to help keep money in pocket.

Further objects and advantages of this invention are, it can be used easily and conveniently, yet, it is small enough to store in the trunk of any automobile. It is economical due to its durability for repeated use—not to mention plans for an affordable price tag. Still further objects and advantages will become apparent from a consideration of the ensuing description and drawings.

DRAWING FIGURES

REFERENCE NUMERALS IN DRAWINGS

| |
|---|
| 10 Nozzle |
| 12 Handle |
| 14 Quantity Indicators |
| 16 Clear Plastic Container |
| 18 Nozzle Stop |
| 20 Butterfly Valve |
| 22 Hose |
| 24 Cap |
| 26 Circular Ring Handle |
| 28 Flaired-bottom Plastic Container |

DESCRIPTION—FIGS. 1 to 6

Figure 1:
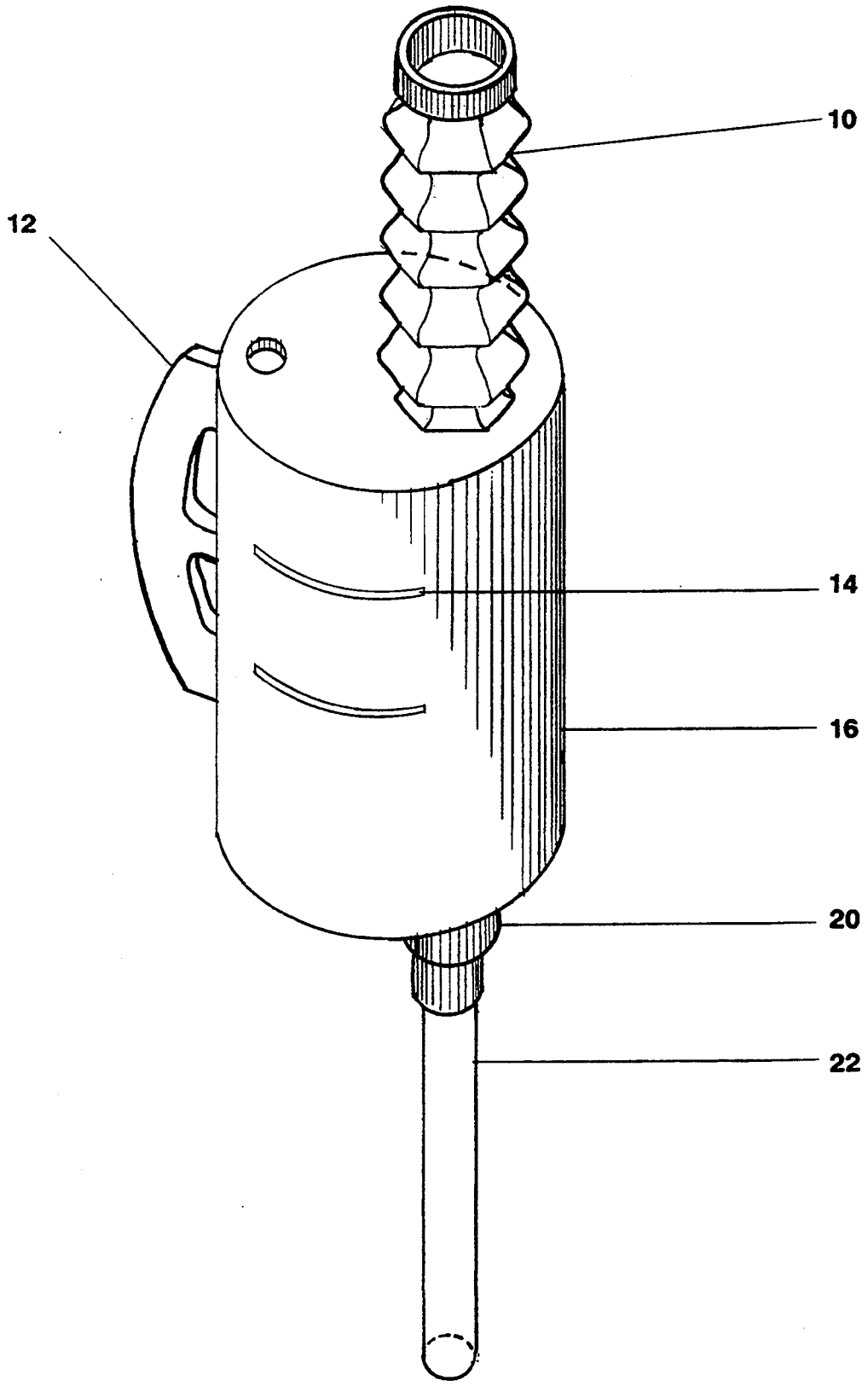
FIG. 1 shows an isometric view of the gasoline tester in accordance with the invention.
Figure 2:
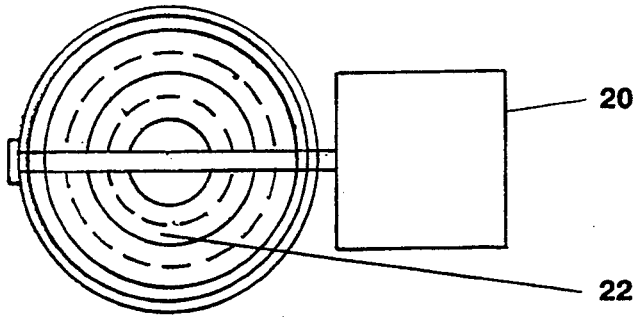
FIG. 2 shows a plan view of the outlet valve in accordance with the invention.
Figure 3:
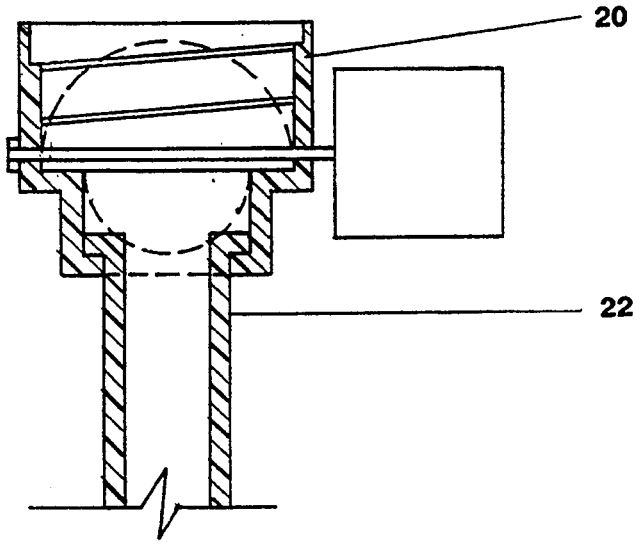
FIG. 3 shows a section view of the outlet valve.
Figure 4:
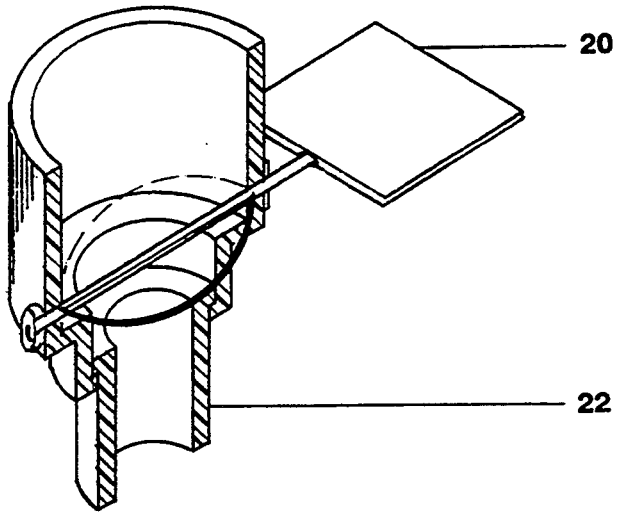
FIG. 4 shows an isometric section view of the valve.
Figure 5:
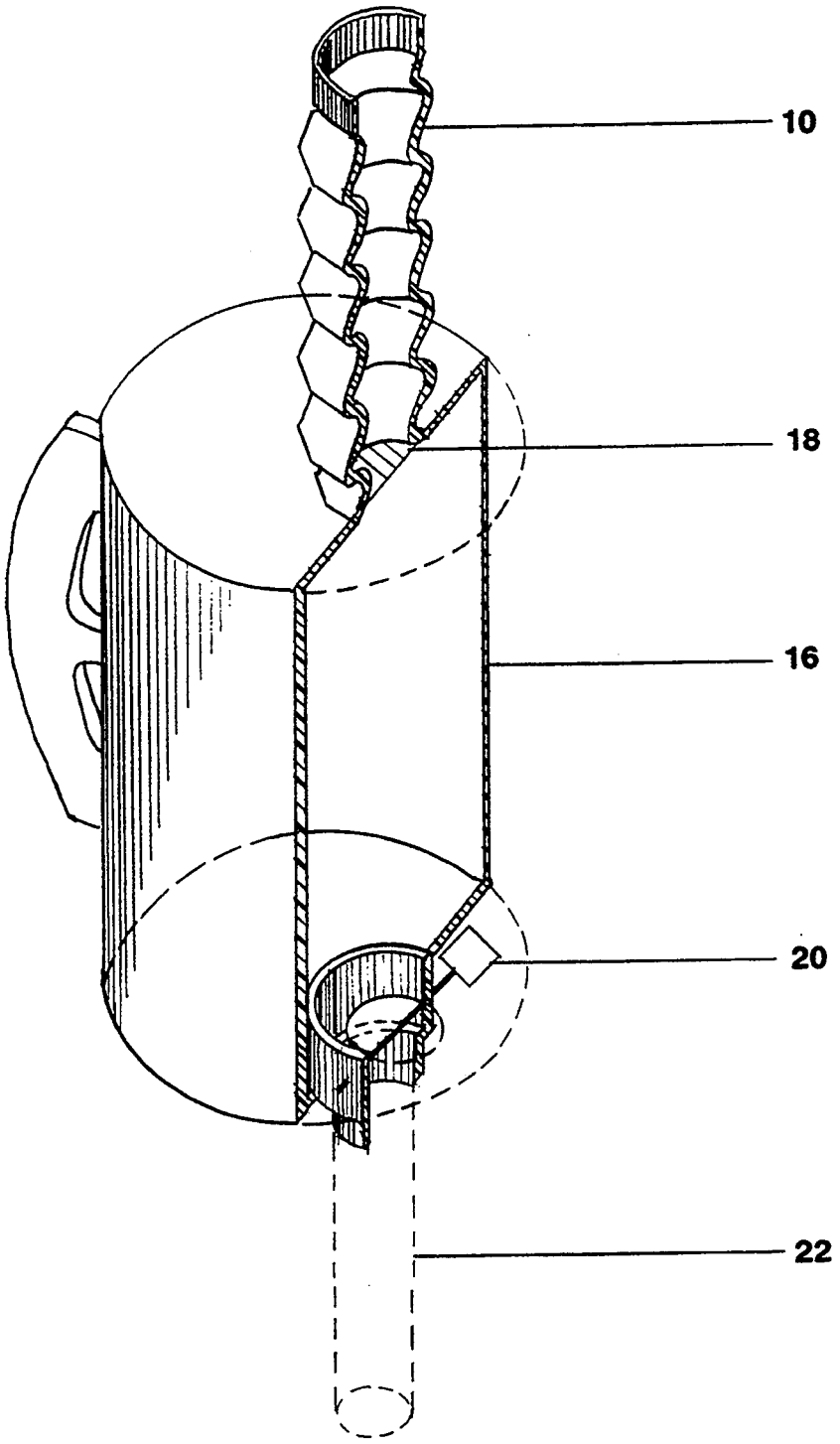
FIG. 5 shows an isometric section view of the gasoline tester with hidden lines included, and, FIG. 6 is an isometric view of a storage container associated with the tester.
Figure 6:
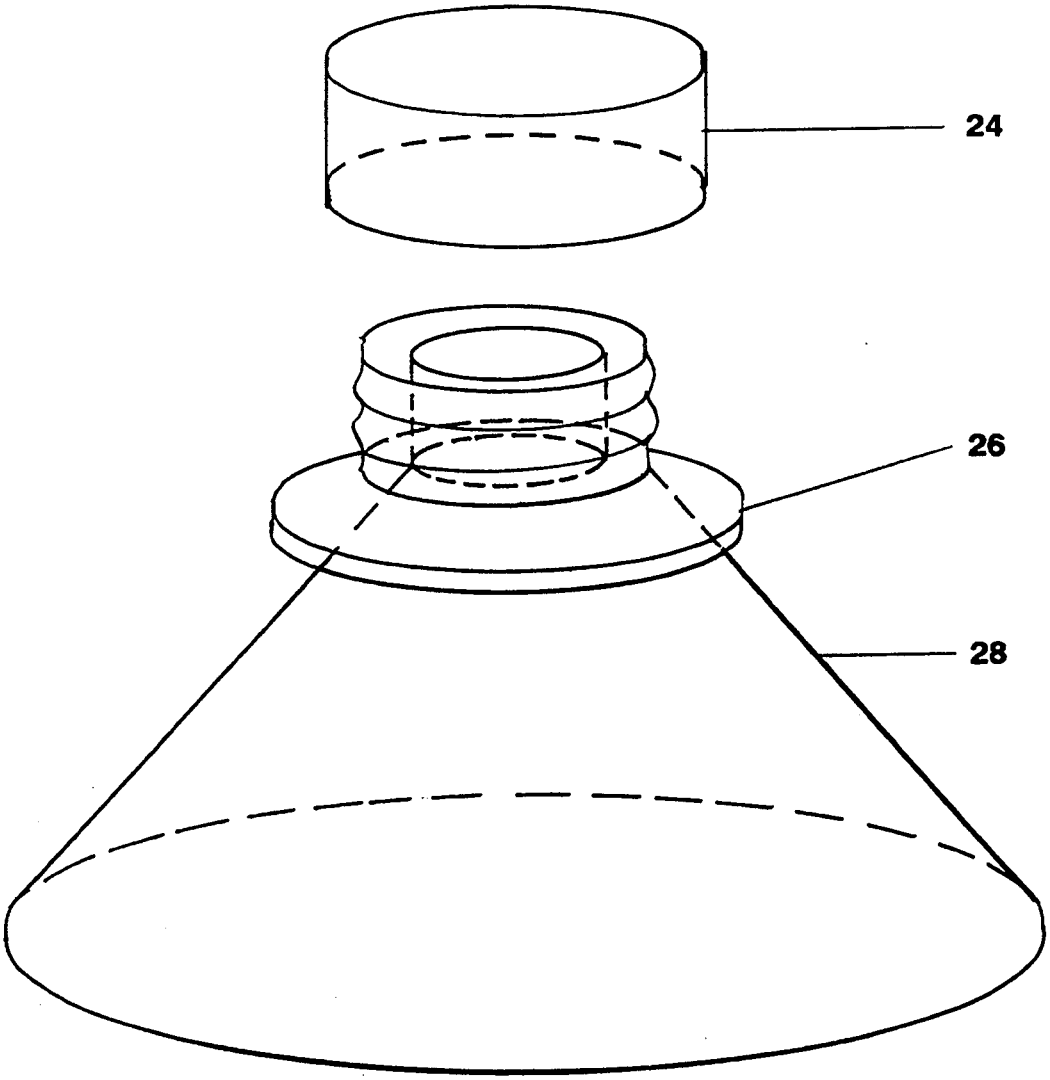

A typical embodiment of the closure of the invention is illustrated in FIG. 1 (full view). The closure has a screw-on flexible nozzle 10 that is based with a plastic nozzle stop 18 all of which connects to a clear plastic container 16 with measurement quantity indicators 14. The clear plastic container has an easy-grip handle 12. The base of the container has a threaded hole for the screw-on butterfly valve 20 that is positioned at the top of a plastic hose 22. FIG. 6 is an additional container for temporary storage of suspect gasoline. The flaired-bottom plastic container 28 has a circular/ring handle 26 and a screw-on cap 24. In the preferred embodiment, the screw-on nozzle and the butterfly valve is detachable for easy replacement. Both plastic containers are made of durable material suitable for holding gasoline and both will clearly display, in writing, the standard regulation safety warnings for gasoline handling. The plastic hose will be a durable, flexible plastic which can be repeatedly bent and straightened out without fracturing.

SUMMARY, RAMIFICATIONS AND SCOPE

Accordingly, the reader will see that the closure of this invention can be used to arm the consumer with a defense against one of the biggest forgery activities known, in terms of victims and dollars—gasoline fraud. This invention was carefully examined with the consumer's investment of an automobile in mind. It was created and designed to be efficient in accomplishing a means to an end, to stop once and for all, consumer victimization of a multi-million dollar scam. The invention, used properly, will assist in providing a superior service for every state across the country; once made obvious, it can potentially make every motorist a gasoline quality control inspector.

Standard regulation safety warnings for gasoline handling will be clearly and permanently outlined on both containers for consumer awareness. Step-by-step instructions for proper usage will be included in the trade dress. The title of the invention is suitably descriptive.

Although the description above contains many specificities, these should not be construed as limiting the scope of the invention but as merely providing illustrations of some of the presently preferred embodiments of this invention. For example, the closure can have other shapes such as oval, circular, etc.; the butterfly valve can be any type of shut-off valve for controllability.

Thus the scope of the invention should be determined by the appended claims and their legal equivalents, rather than by the examples given.

I claim:

1. A portable consumer gasoline tester comprising:

a cylindrical clear hand held plastic container having upper and lower end walls and a connecting elongated side wall therebetween;

an integral handle on said side wall oriented along the longitudinal axis of the side wall for handling the container;

an upper elongated flexible receiving nozzle extending from the upper end wall and communicating with the interior of said container for receiving gasoline therethrough;

a manually actuated dispensing valve attached to the lower end wall with an inlet thereof communicating with the interior of said container, said valve including an outlet having attached thereto a flexible, bendable, elongated plastic outlet tube for directing the output of gasoline from the container when the valve is actuated to the open position;

said container including graduation marks defining at least two distinct volumetric amounts for verifying the accuracy of an associated gasoline metering pump used in conjunction with the apparatus; and;

said tester further comprising an associated storage container for suspect gasoline with an enlarged base for stability, and a closure for sealing the storage container.

* * * * *